United States Patent [19]

Crowley

[11] 4,249,387

[45] Feb. 10, 1981

[54] REFRIGERATION OF LIQUEFIED PETROLEUM GAS STORAGE WITH RETENTION OF LIGHT ENDS

[75] Inventor: Ralph P. Crowley, Woods Cross, Utah

[73] Assignee: Phillips Petroleum Company, Bartlesville, Okla.

[21] Appl. No.: 52,533

[22] Filed: Jun. 27, 1979

[51] Int. Cl.[3] ..... F17C 7/02

[52] U.S. Cl. ..... 62/54; 220/85 VR

[58] Field of Search ..... 62/54, 55; 220/85 VR, 220/85 VS; 55/88, 89

[56] References Cited

U.S. PATENT DOCUMENTS

| | | | |
|---|---|---|---|
| 1,545,352 | 7/1925 | Rodriguez | 62/54 |
| 2,001,996 | 5/1935 | Whitman | 62/54 |
| 2,059,942 | 11/1936 | Gibson | 62/54 |
| 2,246,875 | 6/1941 | Carney | 62/54 |
| 2,535,364 | 12/1950 | Lee | 62/54 |
| 2,765,872 | 10/1956 | Hartman et al. | 55/88 |
| 2,784,560 | 3/1957 | Johnson, Jr. | 62/54 |
| 2,790,307 | 4/1957 | Ayres | 62/54 |
| 2,938,360 | 5/1960 | Christensen | 62/54 |
| 2,944,405 | 7/1960 | Basore et al. | 62/54 |
| 3,150,495 | 9/1964 | Reed | 62/54 |
| 3,191,395 | 6/1965 | Maher et al. | 62/54 |
| 3,195,316 | 7/1965 | Maher et al. | 62/54 |
| 3,251,191 | 5/1966 | Reed | 62/45 |
| 3,303,660 | 2/1967 | Berg | 62/514 R |
| 3,733,838 | 5/1973 | Delahunty | 62/54 |
| 3,857,245 | 12/1974 | Jones | 62/240 |

*Primary Examiner*—Ronald C. Capossela

[57] ABSTRACT

Vapor vented from a liquefied petroleum gas storage container, vessel, or pit is compressed, cooled, and condensed. The condensate is admixed with liquefied petroleum gas taken from said storage and the admixture thus obtained is returned to said storage.

3 Claims, 2 Drawing Figures

REFRIGERATION OF LIQUEFIED PETROLEUM GAS STORAGE WITH RETENTION OF LIGHT ENDS

BRIEF SUMMARY OF THE INVENTION

In an LPG (Liquefied Petroleum Gas) refrigerated storage pit or vessel into which LPG is pumped periodically or continuously and from which LPG is pumped out to sales or other disposal periodically or continuously, vapors are removed, compressed, cooled, and a condensate thus obtained is admixed with liquid LPG taken from the body of liquid in the pit and following which admixture, the admixture thus obtained is returned to the storage pit. In one embodiment, liquid from the storage pit is pumped from within the storage pit by external conduit into a conduit returning the condensate, earlier described, to the storage pit. The invention is particularly applicable to an existing storage structure.

DETAILED DESCRIPTION

This invention relates to the refrigerated storage of a liquefied petroleum gas e.g. LPG (Liquefied Petroleum Gas). In one of its aspects, the invention relates to the operation of an LPG storage container, vessel, or pit into which LPG is pumped for storage and ultimate disposal and from which LPG is pumped for ultimate disposal, e.g. sales. In a further aspect of the invention it relates to a refrigeration cycle. More specifically, the invention relates to a method and apparatus for retention of light ends within the storage space.

In one of its concepts, the invention provides a method for storage of LPG wherein vapors generated in storage are taken off, compressed, cooled, and condensed, condensate liquid thus obtained is admixed with LPG and the admixture is returned to storage. In another of its concepts, the invention relates to an apparatus comprising an LPG storage container, vessel, or pit, means for pumping LPG into said pit, means for pumping LPG from said pit, means for taking vapor from above the liquid level in said pit, means for compressing, cooling, and condensing at least a portion of said vapors, means for admixing condensate thus obtained with at least a portion of LPG from storage and means for returning admixture thus obtained to said storage.

Figure 1:
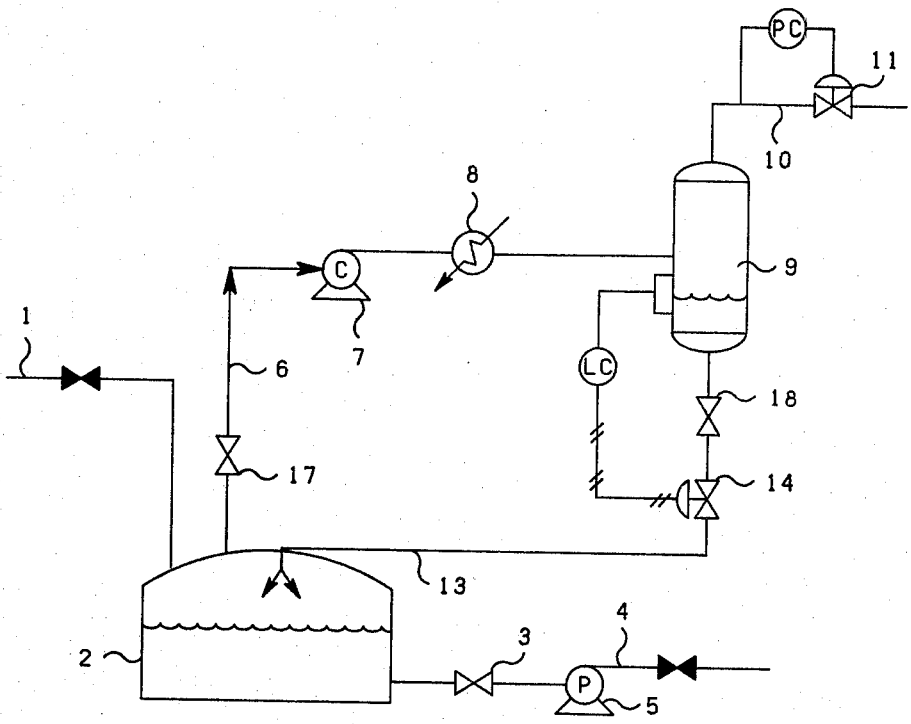
In FIG. 1 of the drawing there is shown diagrammatically an operation to which the invention is advantageously applied.

Referring now to FIG. 1, LPG is pumped by inlet 1 to LPG storage 2 and from storage by 3 and 4 by means of pump 5 to ultimate disposal or sales. Vapor is taken from storage 2 by valve 17 conduit 6, compressor 7, and condenser 8, producing a cooled, compressed, and now condensed vapor in equilibrium with some vapor. This condensate is passed to high pressure receiver 9, from which some light ends, principally ethane are vented by 10 through pressure control valve 11. A liquid level is maintained in receiver 9. Liquid is removed through valve 18 and flow control valve 14 and returned by line 13 to the storage pit or vessel 2.

Figure 2:
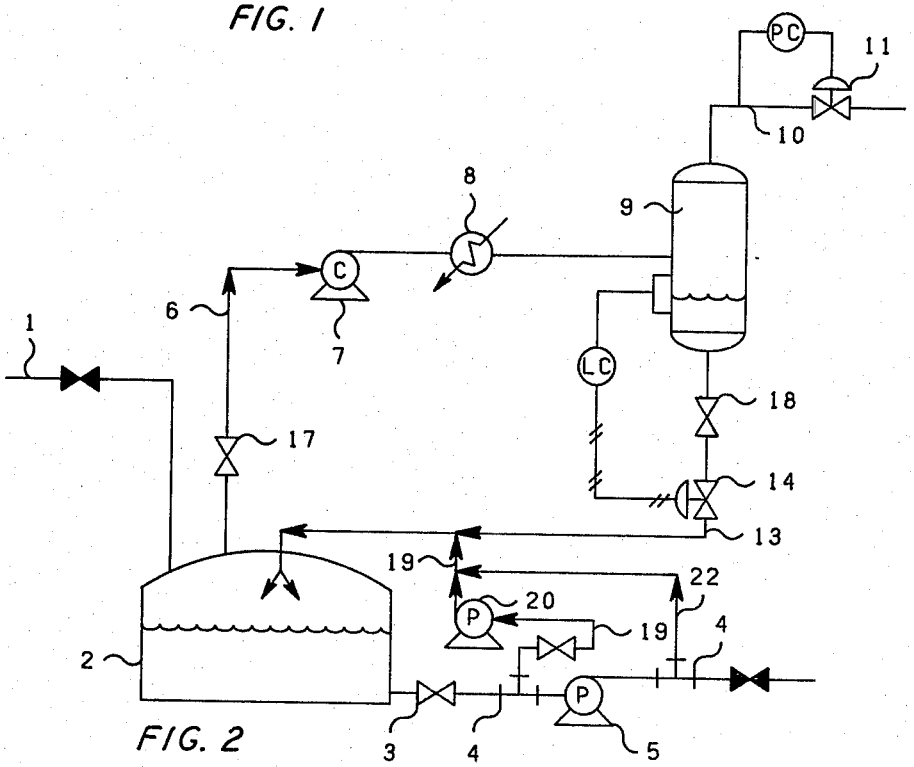
In FIG. 2 the application of the invention to the operation of FIG. 1 is shown.

Referring now to FIG. 2, there is provided a cross-over line 19 connecting the LPG withdrawal line to line 13. A pump 20 is provided in line 19. Alternately, a cross-over line 22 is taken from the discharge of pump 5 into line 19 and then to line 13. Line 22 can directly connect into line 12, if desired.

When LPG is being disposed as to sales, stream 22 can be continuously admixed with condensate taken from the foot of receiver 9. When pump 5 is shut down, pump 20 is operative at least sufficiently long to reestablish a desired temperature and therefore pressure in the storage space.

In an existing storage pit, there will of course be LPG. The pit is in constant use. It is undesirable to empty the same. Accordingly, the invention permits ready modification of an existing arrangement.

It is an object of this invention to provide a refrigerated liquefied petroleum gas storage. It is another object of the invention to provide a method for storing liquefied petroleum gas. It is a further object of the invention to provide for refrigerating a liquefied petroleum gas storage vessel, container, or pit. It is a further object of the invention to provide a method and apparatus for preventing loss of light ends from a refrigerated liquefied petroleum gas storage, e.g. from an LPG mass.

Other aspects, concepts, and objects are apparent from a study of this disclosure, the drawing, and the appended claims.

According to the present invention, there is provided a method for refrigerating a liquefied petroleum gas in storage which comprises taking vapor from vapor space in said storage, compressing the same, cooling the same, thus forming a condensate, admixing condensate thus obtained with liquefied petroleum gas taken from said storage and passing the admixture thus obtained into said storage.

Also according to the invention, there is provided an apparatus comprising in combination a storage vessel, container, or pit, means for feeding to said pit a liquefied petroleum gas, means for taking liquefied petroleum gas from said pit, means for removing vapor from the vapor space in said storage pit, means for compressing, condensing, and receiving condensate, means for returning said condensate to said storage and means for admixing with said condensate prior to its return to said storage, a portion of liquefied petroleum gas taken from said storage.

The following example has been calculated to further and to more fully describe the operation of the invention.

| | Figure 1 | Figure 2 |
|---|---|---|
| Tank 2: | | |
| Pressure, inches $H_2O$, | 7 | 7 |
| Temperature, °F., | −49 | −55 |
| Condensate in 13, Recycled to Tank 2 | | |
| Gallons/hr., | 1000 | 1000 |
| Temperature, °F., | 70 | 70 |
| Volume % Ethane | 17.0 | 16.4 (lower) |
| Pressure in Tank 9, psig, | 215 | 215 |
| Tank Recycle via 20, | | |
| Volume, gallons/hr., | not done | 10,000 |
| Temperature, °F., | — | −55 |
| Mixed Condensate 13 and Recycle | not done | |
| Volume, gallons/hr., | — | 11,000 |
| Temperature, °F., | — | −44 |
| MOL % Ethane | — | 4 |
| Loss to Fuel 10, | 3% loss in LPG for each 1% contained $C_2$ | 0 |

-continued

| | Figure 1 | Figure 2 |
|---|---|---|
| LPG Product 4, | | |
| Gallons/hr., | (as desired) | (as desired) |
| Vapor Pressure, psi, | 180 | 208 |

Reasonable variation and modification are possible within the scope of the foregoing disclosure, drawing, and the appended claims to the invention the essence of which is that a condensate obtained upon compressing and cooling vapors from a liquefied petroleum storage container vessel or pit are admixed with liquefied petroleum gas taken from said pit and the admixture thus obtained is returned to said pit and that an apparatus has been set forth in which to carry out the method, especially upon an existing installation.

I claim:

1. A method for refrigerating a liquefied petroleum gas in storage which comprises taking vapor from vapor space in said storage, compressing the same, cooling the same, thus forming a condensate, admixing condensate thus obtained with liquefied petroleum gas taken from said storage and passing the admixture thus obtained into said storage.

2. A method according to claim 1 wherein the admixture is introduced into a top portion of said storage above the liquid level therein.

3. An apparatus comprising in combination a storage vessel, container, or pit, means for feeding to said pit a liquefied petroleum gas, means for taking liquefied petroleum gas from said pit, means for removing vapor from the vapor space in said storage pit, means for compressing, condensing, and receiving condensate, means for returning said condensate to said storage and means for admixing with said condensate prior to its return to said storage, a portion of liquefied petroleum gas taken from said storage.

* * * * *